US009470488B2

(12) United States Patent
Motz

(10) Patent No.: US 9,470,488 B2
(45) Date of Patent: Oct. 18, 2016

(54) REAR DEPLOYING BROADHEAD HUNTING ARROW

(71) Applicant: Troy Allen Motz, Lawndale, NC (US)

(72) Inventor: Troy Allen Motz, Lawndale, NC (US)

( * ) Notice: Subject to any disclaimer, the term of this patent is extended or adjusted under 35 U.S.C. 154(b) by 0 days.

(21) Appl. No.: 14/292,915

(22) Filed: Jun. 1, 2014

(65) Prior Publication Data

US 2015/0345917 A1 Dec. 3, 2015

(51) Int. Cl.
*F42B 6/08* (2006.01)
*F42B 12/34* (2006.01)

(52) U.S. Cl.
CPC *F42B 6/08* (2013.01); *F42B 12/34* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,579,348 | A * | 4/1986 | Jones | 473/583 |
| 4,932,671 | A * | 6/1990 | Anderson, Jr. | 473/583 |
| 4,998,738 | A * | 3/1991 | Puckett | 473/583 |
| 7,713,151 | B2 * | 5/2010 | Fulton | 473/583 |
| 8,007,382 | B1 * | 8/2011 | Sanford | 473/583 |

* cited by examiner

*Primary Examiner* — John Ricci
(74) *Attorney, Agent, or Firm* — John Dellinger

(57) ABSTRACT

The present invention is a rear-deploying broadhead with a body that is attachable to an arrow shaft. The body has an inner portion and an outer cylinder, with the inner portion being disposed within the outer cylinder when the broadhead is in a nondeployed position. The inner portion has a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve. The outer cylinder comprises slots there-through adapted for deployment of blades.

5 Claims, 4 Drawing Sheets

REAR DEPLOYING BROADHEAD HUNTING ARROW

CROSS-REFERENCE TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Field of the Invention

The present invention relates to the field of archery. More particularly, the present invention is directed to a broadhead hunting arrow in which the cutting blades are deployed from the rear position of the broadhead upon impact with the target. The deployment is affected by a piston or plunger mechanism which is disposed within the body of the broadhead. The blades of the broadhead are retracted within the body of the broadhead and retained in recesses within the body of the broadhead during the flight of the arrow. The blades deploy upon impact with the quarry.

BACKGROUND OF THE INVENTION

The bow and arrow is a projectile weapon system that predates written history. The bow is a flexible arc which shoots aerodynamic projectiles called arrows. Generally, the two ends of the bow are joined together with a string such that when the string is drawn back, the ends of the bow are flexed. An arrow is placed upon the string and the string is drawn back. When the string is released, the potential energy of the flexed stick is transformed into the velocity of the arrow. Bows and arrows have historically been important weapons, but are used primarily for hunting and the sport of archery today.

An arrow generally consists of a shaft with an arrowhead attached to the front end, with fletchings and a nock at the other. Modern arrows may be made of any suitable material, including but not limited to carbon fiber, aluminum, fiberglass, and wood shafts. Carbon shafts have the advantage that they do not bend or warp, but they can often be too light weight to shoot from some bows and are expensive. Aluminum shafts are less expensive than carbon shafts, but they can bend and warp from use. Wood shafts are the least expensive option but often will not be identical in weight and size to each other and break more often than the other types of shafts.

The end of the arrow that impacts the target is the arrowhead. Historically, arrowheads have been made from various materials including flint, bone, horn, or metal. Most modern arrowheads are made of steel, but wood and other traditional materials are still used occasionally. Typically, the arrowhead is provided or manufactured separately from the arrow shaft and is attached to the arrow. For example, the arrowhead can be attached by tangs or sockets. Among arrowheads, three common types include bodkins, broadheads, and piles. Bodkin heads are simple spikes made of metal of various shapes. A broadhead arrowhead is usually triangular or leaf-shaped and has a sharpened edge or edges. Broadheads are commonly used for hunting. A pile arrowhead is a simple metal cone, either sharpened to a point or somewhat blunt, that is used mainly for target shooting.

As noted above, a broadhead is a particular type of arrow head which has outwardly extending blades that are designed to inflict more extensive damage to the animal. An objective for any broadhead is to have the animal killed as quickly as possible such that the animal will not suffer for a long period of time and so that the animal will be recoverable by the hunter. Typically, modern hunting arrows comprise a fiberglass or graphite shaft on which the broadhead body is threadably mounted.

There is a need for an improved broadhead. The flight of prior art broadheads in which the blades are secured on the orrow in a fully open position was adversely affected by wind resistance acting against the exposed broadhead blades. Accordingly, broadheads with fixed blades tend to be less accurate because of wind current deflection and tend to have less velocity because of increased drag. Modern design efforts for broadheads have focused on decreasing the wind effects to ensure a more accurate and effective broadhead. These efforts typically involve reducing the surface area of a broadhead blade to reduce the undesirable steering effects of the wind. However, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed, surface area is reduced and thus produces relatively less undesirable steering effects. Unfortunately, these blade-opening arrowheads are often complex mechanically and include a significant force holding the blades close. This significant force can be difficult to overcome, and these devices may fail to open reliably. Others have structural defects within the body that can result in premature opening of the blade. In either case, the arrow does not penetrate the target. Examples include U.S. Pat. Nos. 5,112,063, 4,998,738 and 5,082,292. In these examples, the deployable cutting blades are connected by pivot features to a plunger. The cutting blades pivot between an open cutting position and a closed non-barbed position. In U.S. Pat. No. 5,102,147, a ballistic broadhead assembly has blades pivotally mounted on an actuating plunger. Upon impact, the actuating plunger thrusts the blades outwardly and forwardly.

Other broadheads which have blades partially hidden within the body use annular retaining rings, such as O-rings, wraps, bands and the like, in order to maintain the blades in a closed position during flight. Upon impact, such annular retaining rings are designed to sheer or roll back along the opening blades, in order to allow the blades to move to an open position. These conventional annular retaining rings are prone to cracking, particularly when the elastomer material dries out. Upon release of a bowstring, the rapid acceleration and thus significant opening forces move the blades in an opening direction. The conventional annular retaining rings counteract the opening forces, but fail of the ring material is brittle or damaged. Moreover, many of the annular retaining rings are designed for one use and thus must be replaced after each use. In addition to the cost involved with supplying such consumable item, the annular retaining rings are difficult and time-consuming to install, such as when hunting, particularly during inclement weather. Furthermore, the material properties of such conventional annular retaining rings can be affected by temperature changes, thereby resulting in different bias forces that cause the blade to open prematurely or to not open when desired.

A final group of mechanical broadheads deploys the blades in an over-the-top motion, such as that disclosed in U.S. Pat. No. 5,090,709. The extendable blades are pivotally connected to a body near the rear of the broadhead body. A ring releasably holds the extendable blades within corresponding slots within the body. These over-the-top broadheads often fail when the blades do not fully open until after the blades enter the target. Consequently, the full cutting diameter of an over-the-top broadhead is often not available through the depth of the target.

BRIEF SUMMARY OF THE INVENTION

It is an object of the present invention to provide a broadhead hunting arrow in which the cutting blades are deployed from the rear position of the broadhead upon impact with the target. The deployment is affected by a piston or plunger mechanism which is disposed within the body of the broadhead. The blades of the broadhead are retracted within the body of the broadhead and retained within recesses within the body of the broadhead during the flight of the arrow. The blades deploy upon impact with the quarry.

In an embodiment of the present invention, the broadhead can be affixed to the shaft in any manner known in the art. In a preferred embodiment, the broadhead is threadably attached to the shaft. In an embodiment, the broadhead is comprised of an outer cylinder and an inner portion. The outer cylinder has first and second ends and is adapted such that the inner portion of the broadhead are disposed within the outer cylinder. The outer cylinder may preferably have a threadable portion on a first end which threadably attaches the cylinder to an arrow shaft. The embodiment has a threadable inner portion or tapered surface on a second end which is adapted to receive the remaining portions of the broadhead. The outer cylinder comprises slots there-through adapted for deployment of blades. The inner portion comprises a solid internal shaft disposed in a position forward to a head of the broadhead. The solid internal shaft is situated substantially in the center of the inner portion and is movable within an inner cylinder in a plunger-like manner within the inner portion. The solid internal shaft terminates within the inner cylinder and is attached proximate its termination to an internal sleeve. At least two blades are pivotally attached to the internal sleeve. When disposed within the outer cylinder, the blades are folded inward by means of additional pivots, and the blades are pivotally attached to the head of the broadhead forward on the inner portion. The inner cylinder further may comprise recesses adapted to house the non-deployed blades. To fully deploy the broadhead, the arrow comprising the broadhead is launched. Upon impact with the target, the first impact is upon the solid internal shaft. The internal shaft is depressed toward the head of the broadhead in a plunger-like manner. On the termination of the internal shaft, the sleeve is pushed away from the impacted target by the solid internal shaft, thereby causing the blades to be deployed from the rear of the broadhead through the slots in the outer cylinder. The blades are held in the deployed position by force.

This summary of the invention does not necessarily describe all features of the invention.

BRIEF DESCRIPTION OF THE SEVERAL VIEWS OF THE DRAWINGS

These and other features of the invention will become more apparent from the following description in which reference is made to the appended drawings wherein.

REFERENCE NUMERALS IN THE DRAWINGS

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements.

Figure 1:
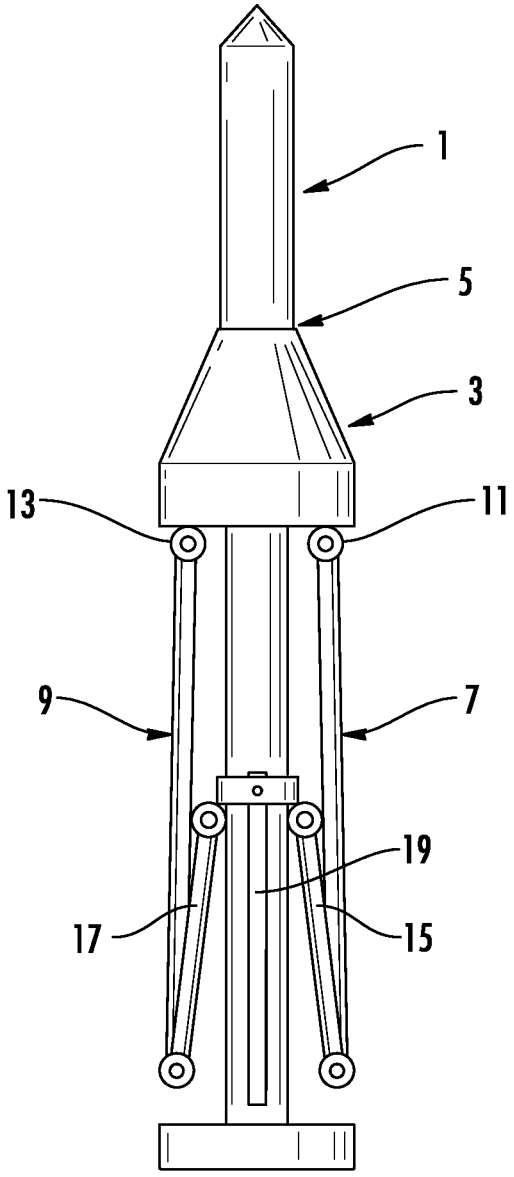
FIG. 1 is an isometric view of an embodiment of the inner portion of the broadhead in a non-deployed position.
Figure 2:
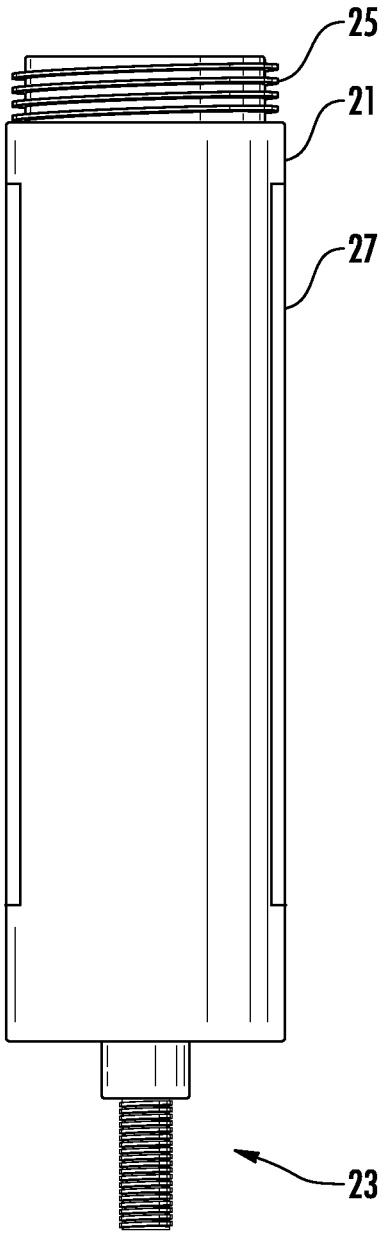
FIG. 2 is an isometric view of an embodiment of the outer cylinder of the broadhead in a non-deployed position.
Figure 3:
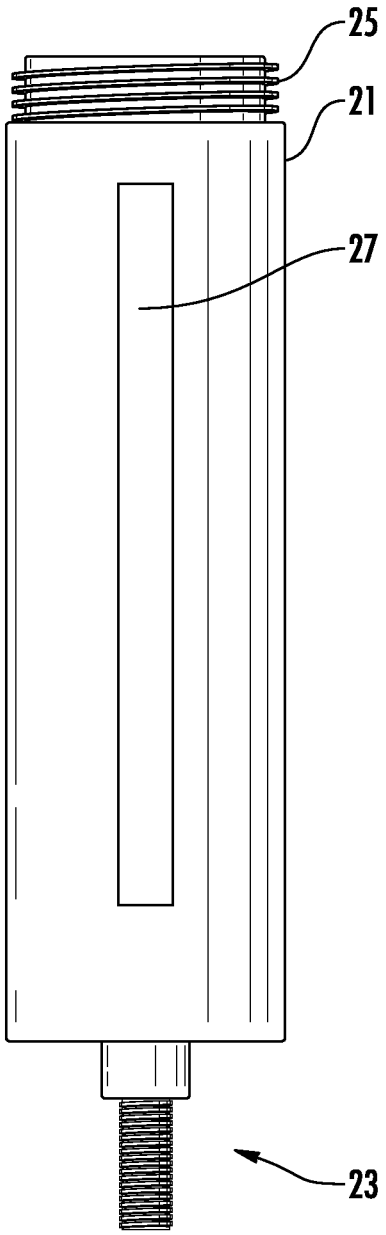
FIG. 3 is a cross-sectional view of an embodiment of the outer cylinder of the broadhead in a non-deployed position.
Figure 4:
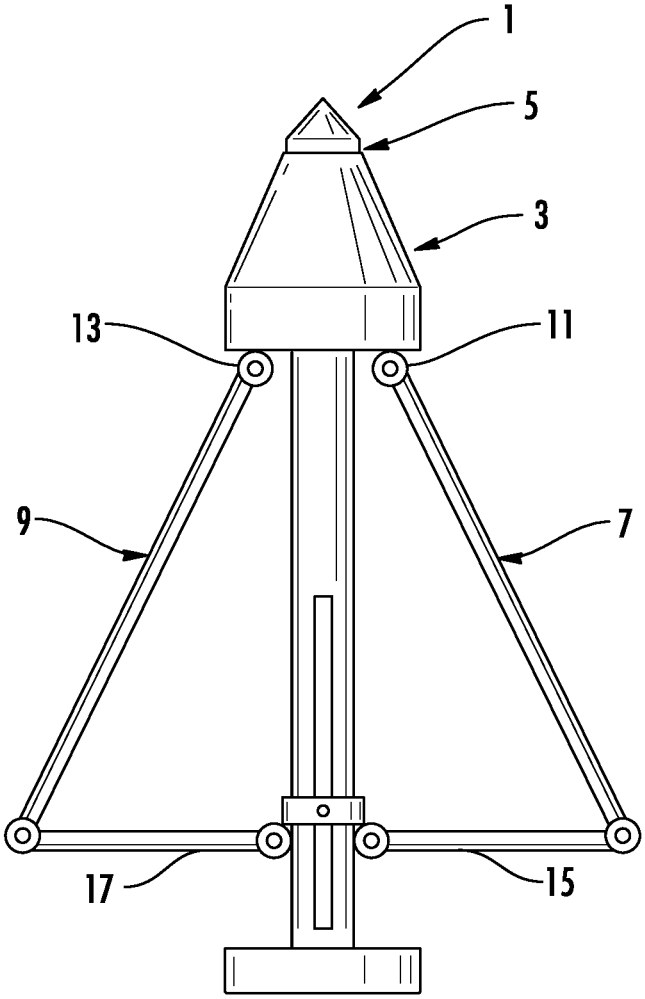
FIG. 4 is a cross-sectional cutaway view of the inner portion of the broadhead disposed within the outer cylinder in a deployed position.
Figure 5:
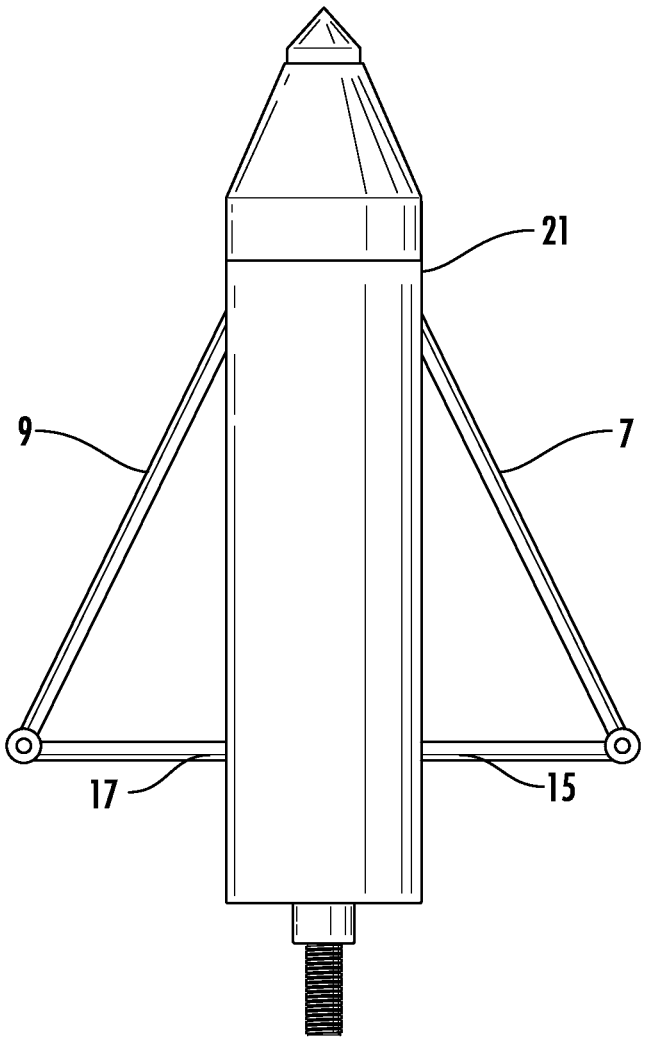
FIG. 5 is a deployed view of an embodiment of the present invention.

A first embodiment of the present invention is shown in detail in FIGS. 1-5. FIG. 1 shows an embodiment of the inner portion of the broadhead of the present invention in a non-deployed position. In a non-limiting example, this inner portion is within an outer shell. A solid internal shaft 1 extends forward of an inner sleeve 3. The intersection of the internal shaft 1 and the inner sleeve 3 may comprise a seal 5 such as a Teflon seal. The inner sleeve 3 may taper. A first blade 7 and a second blade 9 are pivotally attached to the inner sleeve in forward positions 11 and 13 respectively, and are also attached pivotally at more rearward positions 15 and 17, respectively. The inner sleeve additionally may comprise recesses 19 adapted to receive the non-deployed blades. FIG. 2 shows an embodiment of the outer cylinder of the broadhead in a non-deployed position. The outer cylinder 21 comprises a threadable portion 23 on a first end for attachment of the cylinder to an arrow shaft. The outer cylinder further comprises a threadable portion 25 on a second end which is adapted to receive the remaining portions of the broadhead. Slots 27 are adapted for the deployment of blades. FIG. 3 is a cross-sectional view of an embodiment of the outer cylinder of the broadhead in a non-deployed position. FIG. 4 is a cutaway view of the inner portion of the broadhead disposed within the outer cylinder in a deployed position. FIG. 5 is a view of the present invention in a deployed position, with the blades 7 and 9 deployed through the slots 27.

In a preferred embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The outer cylinder has first and second ends, with the first end being threadably attachable to an arrow shaft, and the second end threadably receives the inner portion of the body.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The inner portion comprises a solid internal shaft, a head, and an inner cylinder. The internal shaft is disposed in a position forward to the head of the broadhead, and is situated substantially in the center of the inner portion and movable within the inner cylinder in a plunger-like manner.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The inner portion comprises a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The inner portion comprises a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve. The blades are folded inward by means of additional pivots when the broadhead is in a nondeployed position, and the blades are pivotally attached to the head of the broadhead forward on the inner portion of the broadhead.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The inner portion comprises a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve. The outer cylinder comprises slots therethrough adapted for deployment of blades.

In a further embodiment, the present invention is a rear-deploying broadhead comprising a body attachable to an arrow shaft. The body comprises an inner portion and an outer cylinder wherein said inner portion is disposed within said outer cylinder when the broadhead is in a nondeployed position. The inner portion comprises a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve. The inner cylinder further comprises recesses adapted to house the non-deployed blades.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

I claim:

1. A rear-deploying broadhead comprising a body attachable to an arrow shaft, said body comprising an inner portion and an outer cylinder wherein said inner portion is disposed within said outer cylinder when the broadhead is in a nondeployed position, wherein the inner portion comprises a solid internal shaft, a head, and an inner cylinder, wherein said internal shaft is disposed in a position forward to the head of the broadhead, and is situated substantially in the center of the inner portion and movable within the inner cylinder in a plunger-like manner, and wherein the solid internal shaft terminates within the inner cylinder and is attached proximate its termination to an internal sleeve, and wherein at least two blades are pivotally attached to the internal sleeve.

2. The broadhead of claim 1, wherein the outer cylinder has first and second ends, and wherein the first end is threadably attachable to an arrow shaft, and wherein the second end threadably receives the inner portion of the body.

3. The broadhead of claim 1, wherein said blades are folded inward by means of additional pivots when the broadhead is in a nondeployed position, and the blades are pivotally attached to the head of the broadhead forward on the inner portion of the broadhead.

4. The broadhead of claim 1, wherein said outer cylinder comprises slots there-through adapted for deployment of blades.

5. The broadhead of claim 1, wherein the inner cylinder further comprises recesses adapted to house the non-deployed blades.

* * * * *